US010647560B1

(12) United States Patent
Guglielmo

(10) Patent No.: US 10,647,560 B1
(45) Date of Patent: May 12, 2020

(54) BOOM LIFT CARTESIAN CONTROL SYSTEMS AND METHODS

(71) Applicant: Enovation Controls, LLC, Tulsa, OK (US)

(72) Inventor: Kennon Guglielmo, San Antonio, TX (US)

(73) Assignee: Enovation Controls, LLC, Tulsa, OK (US)

( * ) Notice: Subject to any disclaimer, the term of this patent is extended or adjusted under 35 U.S.C. 154(b) by 0 days.

(21) Appl. No.: 15/001,179

(22) Filed: Jan. 19, 2016

Related U.S. Application Data

(63) Continuation-in-part of application No. 13/465,683, filed on May 7, 2012, now abandoned.

(60) Provisional application No. 61/482,943, filed on May 5, 2011.

(51) Int. Cl.
*G05G 9/00* (2006.01)
*B66F 11/04* (2006.01)
*B66F 13/00* (2006.01)

(52) U.S. Cl.
CPC ..... *B66F 13/00* (2013.01); *B66F 11/044* (2013.01); *B66F 11/046* (2013.01)

(58) Field of Classification Search
CPC ..... A62C 27/00; E06C 5/04; B66F 17/006; B66F 11/044; B66F 11/04; B66F 11/046; E02F 9/2033
USPC ..... 212/347, 270, 271; 182/19, 2.1, 2.2, 2.3, 182/2.8, 2.11
See application file for complete search history.

(56) References Cited

U.S. PATENT DOCUMENTS 2,472,944 A * 6/1949 Furer ..... B66F 11/048 280/6.15
3,774,217 A * 11/1973 Bonner ..... B66C 13/40 182/148
4,021,019 A * 5/1977 Sanders ..... B66C 13/02 212/308
4,456,093 A * 6/1984 Finley ..... B66F 17/006 182/18
4,815,614 A * 3/1989 Putkonen ..... B66C 23/905 212/272
4,833,615 A * 5/1989 Bitner ..... B66F 17/006 340/685
5,960,969 A * 10/1999 Habisohn ..... B66C 13/063 212/270
6,098,823 A * 8/2000 Yahiaoui ..... B66F 11/044 182/2.9
6,272,413 B1 * 8/2001 Takahashi ..... B66F 11/046 182/115
6,378,653 B1 * 4/2002 Takahashi ..... B66F 11/046 182/62.5

(Continued)

*Primary Examiner* — Daniel P Cahn
(74) *Attorney, Agent, or Firm* — William H. Quirk; Jesse L. Frizzell; Rosenthal Pauerstein Sandoloski Agather LLP

(57) ABSTRACT

Methods and systems for controlling a boom lift, cherry picker, or other similar device are disclosed, including monitoring a controller for an operator desired action; receiving signals from one or more sensors through one or more inputs; using a platform location algorithm and the signals from the one or more sensors to compute current angles and/or lengths of the boom lift; using a platform control algorithm to calculate a control signal to achieve the operator desired action; and using a control signal generator to communicate the control signal to one or more assembly controllers of the boom lift. Other embodiments are desired and claimed.

12 Claims, 4 Drawing Sheets

(56) References Cited

U.S. PATENT DOCUMENTS 6,390,312 B1 * 5/2002 Bean ..... B66F 11/044 182/2.11
6,405,114 B1 * 6/2002 Priestley ..... B66F 11/046 182/18
6,434,437 B1 * 8/2002 Brandt ..... B66C 13/18 212/347
6,496,766 B1 * 12/2002 Bernold ..... B66C 15/065 212/276
6,532,738 B2 * 3/2003 Sharkness ..... E02F 9/2207 60/468
6,553,278 B2 * 4/2003 Handroos ..... B66C 13/066 212/272
6,659,703 B1 * 12/2003 Kirkley ..... B63B 27/10 414/138.2
6,705,079 B1 * 3/2004 Tabor ..... E02F 9/2207 60/469
6,994,223 B1 * 2/2006 Edgar, II ..... B66C 23/905 212/270
7,140,830 B2 * 11/2006 Berger ..... E02F 3/433 414/699
7,278,262 B2 * 10/2007 Moon ..... E02F 9/2207 60/426
7,357,263 B2 * 4/2008 Player ..... B66C 23/66 212/238
7,610,136 B2 * 10/2009 Okamura ..... E02F 9/2207 37/444
7,729,832 B2 * 6/2010 Benckert ..... B66C 13/40 198/318
7,734,397 B2 * 6/2010 Peterson ..... E02F 3/437 172/2
8,359,829 B1 * 1/2013 Ramberg ..... F02D 41/1406 60/274
8,706,363 B2 * 4/2014 Stratton ..... E02F 9/261 144/4.1
8,943,988 B1 * 2/2015 Guglielmo ..... B63H 25/38 114/144 R
9,776,847 B2 * 10/2017 Mondal ..... B66F 17/006
2003/0173151 A1 * 9/2003 Bodtke ..... B66F 17/006 182/18
2004/0262078 A1 * 12/2004 Bailey ..... B66F 11/046 182/2.1
2005/0007553 A1 * 1/2005 Romanoff ..... B66F 11/048 352/243
2005/0224439 A1 * 10/2005 Bean ..... B66F 11/046 212/280
2006/0065485 A1 * 3/2006 Reed ..... A62B 1/02 182/82
2006/0178775 A1 * 8/2006 Zhang ..... B25J 9/1674 700/245
2006/0178825 A1 * 8/2006 Eglington ..... A01B 69/008 701/410
2007/0150149 A1 * 6/2007 Peterson ..... E02F 3/437 701/50
2008/0034853 A1 * 2/2008 Tabor ..... B66F 9/0655 73/114.79
2008/0041805 A1 * 2/2008 Jantti ..... E02F 3/436 212/270
2008/0113568 A1 * 5/2008 Walser ..... B63B 49/00 440/1
2008/0201043 A1 * 8/2008 Sahlin ..... E02F 3/847 701/50
2008/0230320 A1 * 9/2008 Soeda ..... B66C 23/94 187/222
2009/0038186 A1 * 2/2009 Osswald ..... B62D 21/14 37/413
2009/0139119 A1 * 6/2009 Janardhan ..... B25J 9/1638 37/413
2009/0139947 A1 * 6/2009 Harris ..... B66C 23/80 212/278
2009/0145871 A1 * 6/2009 Bond ..... B66F 11/046 212/285
2009/0206589 A1 * 8/2009 Osswald ..... B62D 21/14 280/782
2009/0222176 A1 * 9/2009 Florean ..... E02F 3/432 701/50
2009/0232625 A1 * 9/2009 Almeda, Jr. ..... B66C 23/52 414/139.6
2010/0133043 A1 * 6/2010 Black ..... B66F 11/044 182/148
2011/0047723 A1 * 3/2011 Fleischer ..... B63B 27/14 14/69.5
2011/0209943 A1 * 9/2011 Bowden ..... G01G 19/083 182/18
2012/0174445 A1 * 7/2012 Jones ..... A01B 69/007 37/197
2013/0020775 A1 * 1/2013 Beji ..... B60B 35/10 280/43
2013/0220734 A1 * 8/2013 Guglielmo ..... G05G 9/047 182/63.1
2015/0027808 A1 * 1/2015 Baillargeon ..... B66F 17/006 182/3
2015/0284231 A1 * 10/2015 Grant ..... B66F 17/006 182/19
2016/0176692 A1 * 6/2016 Sawodny ..... B66F 17/006 701/50
2017/0107090 A1 * 4/2017 Mondal ..... B66F 17/006
2017/0254102 A1 * 9/2017 Peters ..... E04G 21/22
2017/0291805 A1 * 10/2017 Hao ..... B60P 1/34
2019/0066884 A1 * 2/2019 Gorghuber ..... H02B 3/00
2019/0107861 A1 * 4/2019 Maier ..... G05G 1/01
2019/0210854 A1 * 7/2019 Eck ..... B66C 13/40

* cited by examiner

BOOM LIFT CARTESIAN CONTROL SYSTEMS AND METHODS

CLAIM OF PRIORITY TO PRIOR APPLICATION

The present application is a continuation-in-part of prior filed co-pending U.S. Non-Provisional patent application Ser. No. 13/465,683 filed May 7, 2012, and also claims the benefit of its prior filed priority document, namely U.S. Provisional Application, Ser. No. 61/482,943 filed May 5, 2011. By this reference, the full disclosures, including the claims and drawings, of U.S. Non-Provisional application Ser. No. 13/465,683 and U.S. Provisional Application, Ser. No. 61/482,943 are incorporated herein as though now set forth in their entirety.

This application is a nonprovisional application under 37 CFR 1.53(b) and is submitted with an accompanying non-publication request in accordance with 35 U.S.C. § 122(b). Accordingly, the subject matter of this application is to be maintained in secrecy until and unless Applicant allows a patent to issue based on this application.

FIELD OF THE INVENTION

The present invention primarily pertains to control systems and methods for boom lifts, cherry pickers, and other similar devices; more particularly it pertains to systems and methods for allowing Cartesian steering controls for said devices.

BACKGROUND

Most boom lifts or other similar vehicles use controls that operate the various components of the lift individually. In these systems, simple Cartesian operations such as lifting the operator platform vertically or horizontally can involve multiple control operations such as extending the lower telescoping boom assemblies, while retracting the upper telescoping boom assemblies, which also changes the angles of said upper and lower boom assemblies. Simple Cartesian operations present a surprisingly complex array of challenges for even skilled and experienced operators to perform with standard control systems.

To overcome this problem the industry has developed Cartesian control systems to provide easy, accurate, and reliable changes in the operator platform's Cartesian location. In such control systems, if the operator wants to move the operator platform up, down, left, or right, all that is needed is a simple button press and the control system calculates and coordinates the proper control actions of the various telescoping assemblies and angles. However, these current systems require the installation and calibration of expensive sensors to measure the overall and current length of the telescoping boom assemblies, sensors to measure the rate of speed of their extension or retraction, sensors to detect the amount of hydraulic pressure to the assemblies' control systems, sensors to monitor the angles of the current assemblies, and other similar sensors. The addition of such sensors and their maintenance and calibration adds significantly to the cost of boom lift and other similar vehicles presenting an obstacle to their adoption. Moreover, because of the need for recurring calibration of such sensors, and the distinct possibility of errors occurring in the calibration process, the reliability of commonly used sensors is questionable.

Many other problems, obstacles, limitations and challenges of the prior art will be evident to those skilled in the art, particularly in light of the prior art.

BRIEF SUMMARY OF THE INVENTION

The present invention provides improved control systems and methods for boom lifts, cherry pickers, and other similar devices; more particularly it pertains to systems and methods for allowing Cartesian steering controls for said devices. While typical control systems include multiple controls for extending and retracting the lower and upper telescoping boom assemblies as well as separate controls to change the angles of said upper and lower boom assemblies, the present invention retains such functionality and improves upon the basic control system by incorporating a Cartesian or equivalent adjustment control into the operator control panel. The telescoping boom assemblies preferably utilize linear actuators for extension and retraction of the boom assembly. For implementing adjustments to the angle of the boom assembly, preferred embodiments incorporate rotary actuators.

Presently preferred embodiments of the present invention, which will be described subsequently in greater detail, generally comprise an accelerometer and gyroscope located on or near the operator platform and which provide data to an electronic controller. Preferred embodiments improve overall reliability of its ability to accurately sense the current positions of the boom lift assembly, in part by combining rotary sensors with a solid state accelerometer and/or a solid state gyroscope. Solid state sensors usually do not require recalibration as often to maintain their accuracy. This is in contrast to standard sensors which could be expected to require recalibration more frequently due to their design and method of operation. The electronic controller uses the inputted data to calculate the Cartesian location of the operator platform and its movement, using an algorithm explained in more detail below. The algorithm constantly refines its estimates multiple times per second.

The apparatus and method for the Cartesian control of the operator platform as described in the present invention substantially departs from the conventional concepts and designs of the prior art, and in so doing provides an apparatus that has many advantages and novel features which is not anticipated, rendered obvious, suggested, or even implied by any of the prior art, either alone or in any obvious combination thereof.

In this respect, before explaining at least one embodiment of the invention in detail, it is to be understood that the invention is not limited in its application to the details of construction and to the arrangements of the components set forth in the following descriptions or illustrated in the drawings. The invention is capable of many other embodiments and of being practiced and carried out in numerous other ways. Also, it is to be understood that the phraseology and terminology employed herein are for the purpose of the description and should not be regarded as limiting.

Other objects, features and advantages of the present invention will become evident to the reader and it is intended that these objects, features, and advantages are within the scope of the present invention.

To the accomplishment of all the above and related objectives, it should be recognized that this invention may be embodied in the form illustrated in the accompanying drawings, attention being called to the fact, however, that the drawings are illustrative only, and that changes may be made in the specifics illustrated or described.

DETAILED DESCRIPTION

Figure 1:
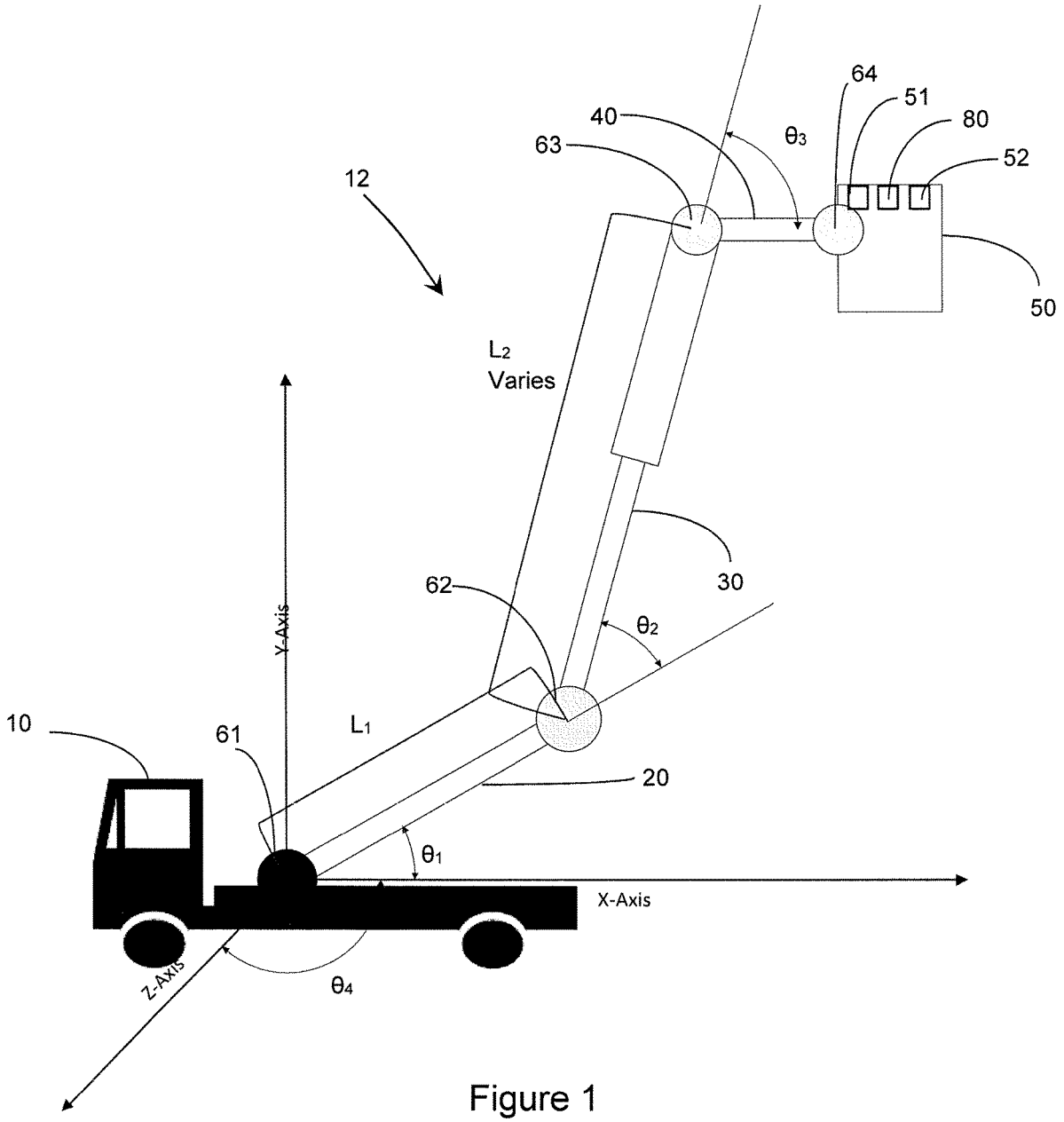
FIG. 1 is a simplified view of a vehicle 10 that embodies and incorporates and uses embodiments of the invention shown with the lower and upper telescoping boom assemblies partially extended.
Figure 1A:
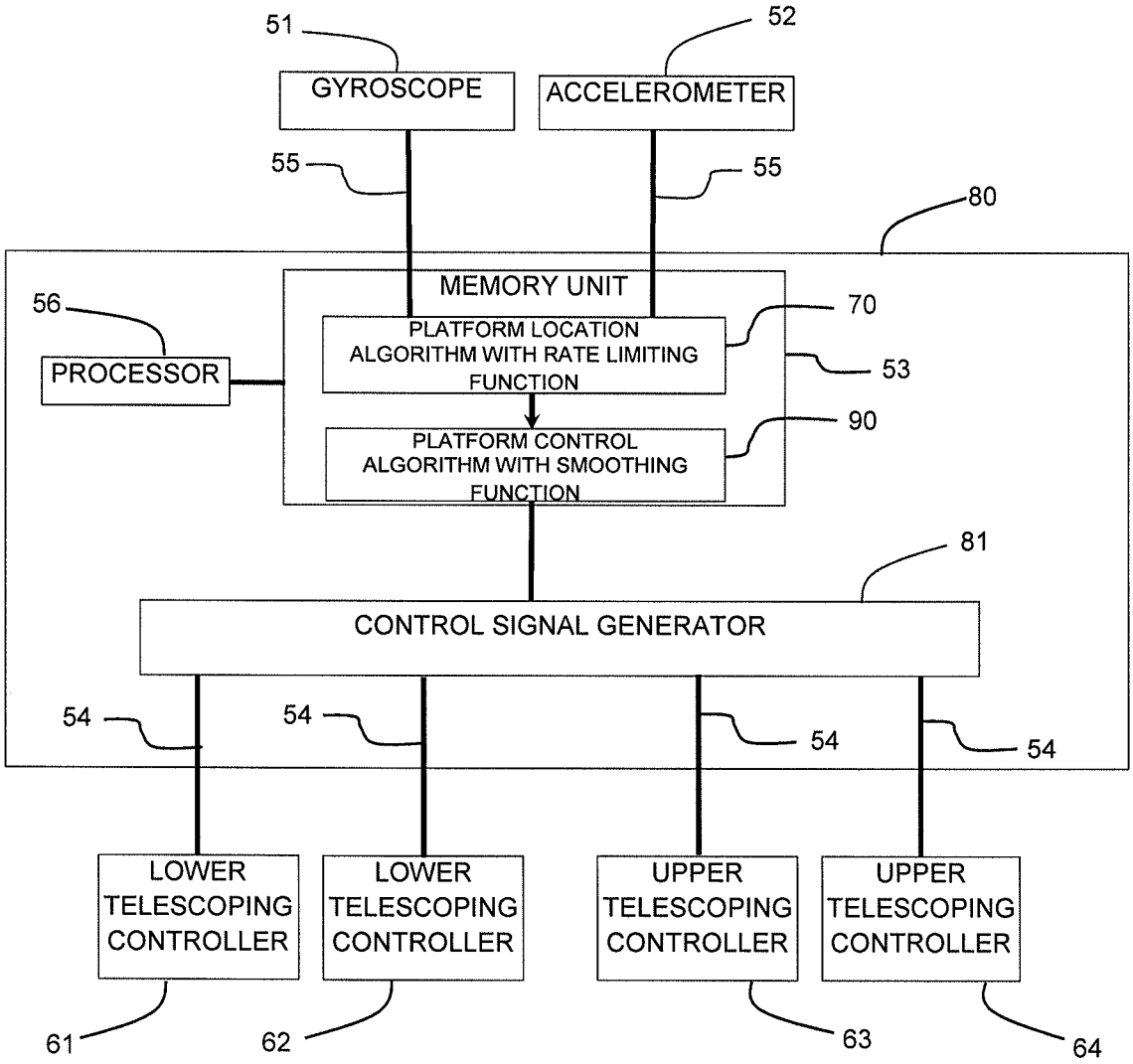
FIG. 1A is a simplified schematic representation of the electronic controller and various related components of the disclosed system.

Reference is made first to FIG. 1 for a brief description of the overall structure of the components of the lift vehicle 10 of the preferred embodiment, wherein lift vehicle 10 includes boom lift 12. The operator platform 50 is attached to the upper telescoping assembly 30, which is in turn attached to the lower telescoping assembly 20. The method of attachment is as is known in the art. Additionally, the number of telescoping assemblies can vary by the requirements for the lift vehicle 10. The operator platform 50 contains the electronic controller 80 as well as the gyroscopic sensor 51 and accelerometer 52. In preferred embodiments, the gyroscopic sensor 51 and accelerometer 52 are solid state sensors. In alternate embodiments, gyroscopic sensor 51 and accelerometer 52 are conventional sensors as would be understood by one of ordinary skill in the art. The actual locations of the electronic controller 80 as well as the locations, types, and number of sensors can vary in alternate embodiments of the invention. Additionally, alternate embodiments can substitute non-telescoping assemblies for the upper and lower telescoping assemblies as well as vary the number of such assemblies. Such alternatives should fall within the scope of some (but not necessarily all) aspects of the present invention, except to the extent clearly excluded by the claims.

Figure 2:
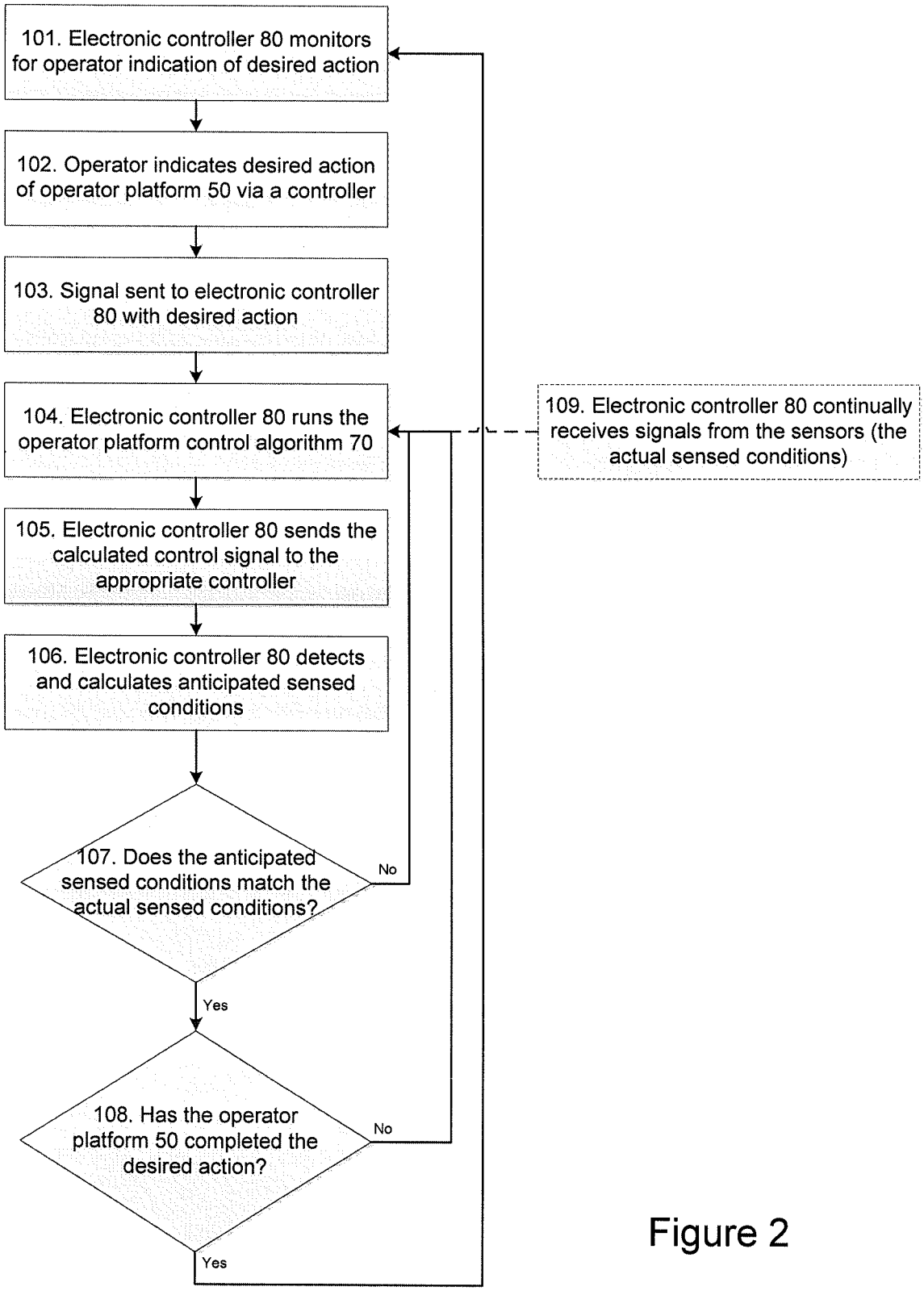
FIG. 2 is a flowchart of the method steps in the operation of the system controlled by the apparatus of the present invention.

Reference is made to FIG. 2 for a generalized flowchart providing the basic method steps associated with the operation of the system of the preferred embodiment and its manner of controlling the operator platform 50 in Cartesian space. The basic functionality shown in FIG. 2 begins at Step 101 wherein the electronic controller 80 monitors the system for any operator indication of a desired action. Typically, these actions will involve some sort of directional movement of the operator platform 50 desired by the operator and is indicated in Step 102 by the operator via a controller. Step 103 involves the signal sent to the electronic controller 80 with the desired action.

In Step 104, the electronic controller 80 runs the operator platform control algorithm 70. The operator platform control algorithm 70 is described in more detail below. The electronic controller 80 and its operator platform control algorithm 70 obtain a continual signal from the gyroscopic sensor 51 and accelerometer 52 containing the actual sensed conditions (Step 109). The algorithm 70 uses the actual sensed conditions to calculate an appropriate control signal to achieve the desired action which is then sent to the appropriate controller in Step 105. The electronic controller calculates an anticipated sensed conditions value for the operator platform control algorithm 70 in Step 106. In Step 107, if the anticipated sensed conditions value calculated in Step 106 does not match the actual sensed conditions then the system returns to Step 104. If the value does match, then the system moves to Step 108, wherein the electronic controller determines if the desired action has been completed. If it has not then the system returns to Step 104; if it has then the system returns to Step 101.

The operator platform control algorithm 70 continually refines its estimates of the anticipated sensed conditions value using the data from the actual sensed conditions along with its previous estimates of the anticipated sensed conditions. It should be understood, though, that the sequence and detail of FIG. 2 are merely exemplary, generalized steps of a preferred process. To the extent still within the scope of the invention as defined in any particular claim, each of those steps 101-109 can be subdivided, combined, transposed, intertwined, eliminated or replaced with equivalents or alternates, as would be known or evident from this description to one of ordinary skill in the art, especially pursuant other teachings known or commercially implemented in the pertinent fields.

Electronic Controller

The electronic controller 80 uses one or more presently available computing devices which contain a processor 56, a memory unit 53, one or more input means 55, and one or more output means 54. One example of a controller which is suitable to be programmed for embodiments of the present invention as described herein is any of the HFX series of programmable controllers commercialized by Eaton Corporation [www.eaton.com]. Such controllers incorporate a processor and a memory unit, as well as having capabilities for receiving inputs and for generating outputs. The electronic controller 80 preferably stores part, or all, of the operator platform control algorithm 70. The electronic controller 80 receives information on the sensed conditions and calculates the desired angle(s) and length(s) according to the operator platform control algorithm 70. The electronic controller 80 then uses its control signal generator 81 to communicate a corresponding angle and/or length command to the appropriate rotary joints (61, 62, 63, 64), each of which serves as a controller for adjusting the angular position of the corresponding telescoping assembly. The rotary joints 61, 62, 63, 64 use commercially available or predictable equipment that receives the angle and/or length control signal from control signal generator 81 either by wire or wirelessly and sets or changes the assembly angle and/or length ($\theta_1$, $\theta_2$, $\theta_3$, $\theta_4$, $L_1$, $L_2$) to the commanded angle and/or length. Control signal generator 81 sends electrical drive signals to hydraulic solenoids to control flow of hydraulic fluid for operating upper and lower telescoping assemblies 20, 30. These signals are based on current, such signals being variable and proportional. For instance, a zero current value indicates no hydraulic fluid flow. A positive current value will result in flow in one direction, and a negative current value will result in flow in the opposite direction.

Platform Location Algorithm

Platform 50 includes sensors such as gyroscopic sensor 51 and accelerometer 52. In some embodiments, the sensors on platform 50 are made from the components of a Zero Off® module commercially available from Applicant, Enovation Controls, LLC, although the GPS functionality of such modules may be removed as unnecessary for functionality of the present invention. In other embodiments, the sensors may be mounted together on a circuit board. For determining the location of platform 50, rotary joint 61 and/or 62 should be actuated or moved below the extension angle.

For example, when the rotational position of rotary joint 62 moves, if the extension of telescoping assembly 30 is relatively short, the accelerations measurable at platform 50 are small as compared to a situation when telescoping assembly 30 is fully extended, wherein the accelerations measurable at platform 50 would be much larger. For instance, when the operator commands platform 50 to move upward, telescoping assembly 30 will extend upward. However, when translating platform 50 in a vertical direction, telescoping assembly 30 will also tilt backward while platform 50 is translated upward. It is when rotary joint 62 moves in this rotational fashion, the length of extension of telescoping assembly 30 can be estimated based on the acceleration measurement made at platform 50.

The following represents the mathematical relationships related to platform location algorithm 90:

A 3-axis accelerometer 52 and a 3-axis gyroscopic sensor 51 are positioned on platform 50. Let $\theta_1$, $\theta_2$, $\theta_3$, $\theta_4$ be measured values using rotational position sensors on each rotary joint. $L_1$ is fixed and known. $L_2$ is not measured but will be estimated:

$\overline{L}_2$=actual length of $L_2$ (unknown)

$\tilde{L}_2$=estimate estimated length of $L_2$ $\overline{L}_{2d}$=desired length of $L_2$ If lift vehicle 10 is stationary, then a point "B" on platform 50 can be described relative to a point "O" at the origin of the XYZ axes as shown in FIG. 1:

$\overline{P}_B=f_P(\theta_1, \theta_2, \theta_3, \theta_4, L_1, L_2)$ $\overline{V}_B=f_V(\theta_1, \dot{\theta}_1, \theta_2, \dot{\theta}_2, \theta_3, \dot{\theta}_3, \theta_4, \dot{\theta}_4, L_1, \overline{L}_2, \dot{\overline{L}}_2)$ $\overline{A}_B=f_A(\theta_1, \dot{\theta}_1, \ddot{\theta}_1, \theta_2, \dot{\theta}_2, \ddot{\theta}_2, \theta_3, \dot{\theta}_3, \ddot{\theta}_3, \theta_4, \dot{\theta}_4, \ddot{\theta}_4, L_1, \overline{L}_2, \dot{\overline{L}}_2, \ddot{\overline{L}}_2)$ $\tilde{P}_B=f_P(\theta_1, \theta_2, \theta_3, \theta_4, L_1, \tilde{L}_2)$ $\tilde{V}_B=f_V(\ .\ .\ .\ , \tilde{L}_2, \dot{\tilde{L}}_2)$ $\tilde{A}_B=f_A(\ .\ .\ .\ \tilde{L}_2, \dot{\tilde{L}}_2, [|\$]\$^{\cdot\cdot}\$\$[|\$]\$^{\cdot\cdot}A\ddot{T}\ddot{L}_2)$ Where the "dot" notation means:

$\dot{x}=(d/dt)x$ $\ddot{x}=(d^2/dt^2)x$; where "t" equals time

And: $\overline{P}_B$, $\overline{V}_B$, $\overline{A}_B$=actual position, velocity, and acceleration of point B—both translational and rotational.

$\tilde{P}_B$, $\tilde{V}_B$, $\tilde{A}_B$=estimated position, velocity, and acceleration of point B—both translational and rotational.

An accelerometer at B will provide the X, Y, Z translational components of $\overline{A}_B$, and by integration $\overline{V}_B$.

A velocity gyroscope (common type) will provide the X, Y, Z rotational components of $\overline{V}_B$.

The only unknown in $\tilde{P}_B$ is $\tilde{L}_2$.

An algorithm that can continuously improve the accuracy of the estimated length $\tilde{L}_2$ is called an "observer" by those of ordinary skill in the art of control theory. One embodiment of such an algorithm can be written as:

$$\tilde{L}_{2new}=\tilde{L}_{2old}+[\dot{\tilde{L}}_{2old}+K_V M_V(\overline{V}_B-\tilde{V}_B)]\Delta t;$$

where $\Delta t$=time step between observer digital updates; $K_V$=a "gain" value which can speed up or slow down how quickly estimates are improved; $M_V$=a "mapping" matrix which inverts the kinematics of $f_V(\ .\ .\ .\ )$.

Clearly, when $(\overline{V}_B-\tilde{V}_B)$ is zero, the estimate of $\tilde{L}_2$ is accurate and no additional corrections to $\tilde{L}_2$ are made at each time step other than simple integration of $\dot{\tilde{L}}_2$.

Operator Platform Control Algorithm

Figure 3:
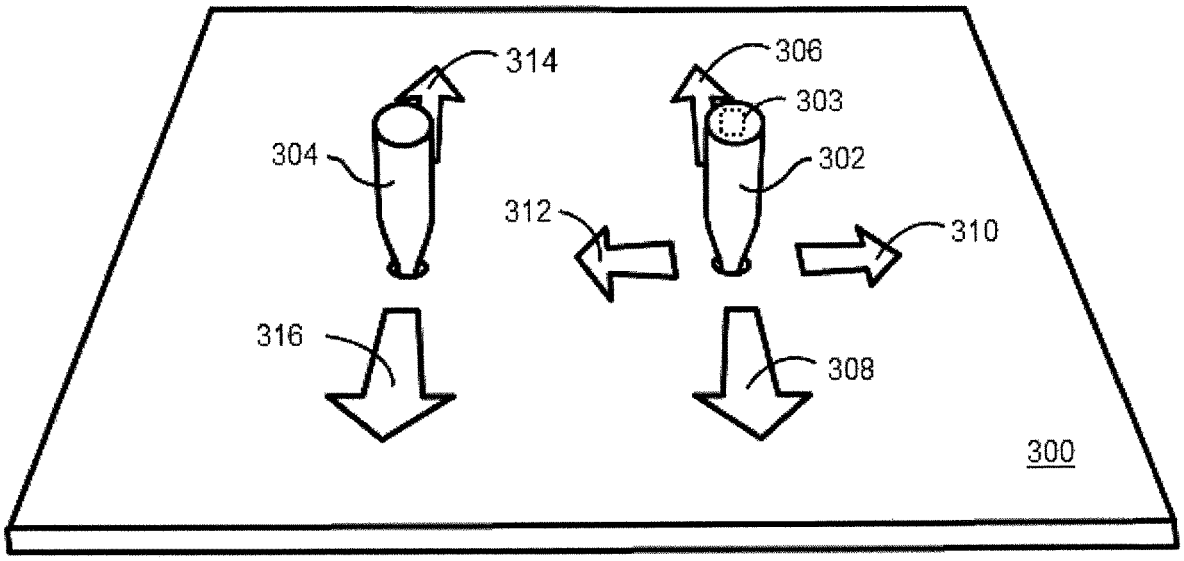
FIG. 3 is a simplified view of a control panel 300 for use with embodiments of the invention.

An operator platform control algorithm 70 is preferably implemented in electronic controller 80. The operator platform control algorithm 70 may include any common or advanced control loop transfer function including, but not limited to, series, parallel, ideal, interacting, noninteracting, analog, classical, and Laplace types. In preferred embodiments, the control loop transfer function actuates hydraulic control valves that regulate the flow of hydraulic fluid to the various actuators. When an operator moves joystick 302 and/or 304 (as shown in FIG. 3), the operator platform control algorithm via the control loop transfer function will start hydraulic fluid flowing to the appropriate actuators(s) to implement the desired operator action. If any corrections are required with respect to hydraulic fluid flow, these corrections will be made on the basis of sensed conditions as determined by gyroscopic sensor 51 and/or accelerometer 52. In other words, the appropriate hydraulic fluid flow is based on the observed position of the telescoping assemblies 20, 30.

The operator platform control algorithm 70 calculates the desired assembly angle and/or length ($\theta_1$, $\theta_2$, $\theta_3$, $\theta_4$, $L_1$, $L_2$) based on input information from an appropriate one or more of the sensors (gyroscopic sensor 51 and accelerometer 52) that are available. The operator platform control algorithm 70 receives input information from the device systems and controls that are equipped with such sensors. As used herein, the term sensor is not limited to a single device detecting and reporting a single condition. A sensor may be one or more devices detecting and reporting one or more conditions. As used in the preferred embodiment the gyroscopic sensor 51 is a solid state sensor which detects the rotational motion and magnitude of the operator platform. The accelerometer sensor 52 is preferably a solid state sensor which detects the linear motion and amplitude of the operator platform.

Based on the input information from one or more sensors, the operator platform control algorithm 70 calculates angles and/or lengths for one or both telescoping assemblies 20 and 30. For each telescoping assembly 20 and 30 it is controlling, the operator platform control algorithm 70 calculates an angle and/or length ($\theta_1$, $\theta_2$, $\theta_3$, $\theta_4$, $L_1$, $L_2$) and a corresponding angle and/or length command to achieve as much. The operator platform control algorithm 70 calculates the desired angle and/or length ($\theta_1$, $\theta_2$, $\theta_3$, $\theta_4$, $L_1$, $L_2$) based on the sensed conditions. However, because of the inherent limits of the control systems, the desired angle and/or length ($\theta_1$, $\theta_2$, $\theta_3$, $\theta_4$, $L_2$) may not be achievable, either instantaneously or at all. An angle and/or length rate limiting function may also be implemented in the electronic controller 80, in rotary joints 61, 62, 63, 64 by some other means, or may not be necessary based on the type of the devices' pre-existing controls. When the control system relies on the algorithm to limit the rate of change of the angle and/or length ($\theta_1$, $\theta_2$, $\theta_3$, $\theta_4$, $L_1$, $L_2$), the algorithm computes intermediate commanded angles and/or lengths to achieve a desired angle and/or length.

The electronic controller 80 preferably includes a comparator function with which the operator platform control algorithm 70 compares the desired angle and/or length ($\theta_1$, $\theta_2$, $\theta_3$, $\theta_4$, $L_1$, $L_2$) with the current angle and/or length (θ1, θ2, θ3, θ4, L1, L2) as detected by gyroscopic sensor 51 and/or accelerometer 52 and computed by the platform location algorithm 90. The algorithm 70 produces a series of intermediate commanded angles and/or lengths (θ1, θ2, θ3, θ4, L1, L2) that achieve the desired angle and/or length (θ1, θ2, θ3, θ4, L1, L2) without exceeding the control system's maximum permissible rate of change of angle and/or length. Further, the operator platform control algorithm 70 is adapted to limit the commanded angle to the vehicle control system's mechanical limits. The operator platform control algorithm 70 also preferably contains a smoothing function to avoid rapid changes in angle and/or length commands. The smoothing function compensates for noise in sensors or controls and for rapid fluctuations in sensed conditions.

Such smoothing function is preferably a standard low-pass filter, the performance of which will be understood by those of ordinary skill in the art.

The operator platform control algorithm 70 also includes internal limitations for other operating and safety considerations. For example, regardless of sensed conditions, the operator platform control algorithm 70 never commands an angle and/or length in excess of the mechanical or safety limits of the telescoping assemblies 20 and 30. In case of certain sensor failures, the electronic controller informs the operator a failure has occurred and commands the telescoping assemblies 20 and 30 to a safe angle and/or length with a safety control signal. In case of electronic controller failure, a fail-safe operates to disable Cartesian movement and allow the vehicle's manual steering system to resume unaided control of the telescoping assemblies 20 and 30.

Turning now to FIG. 3, there is shown a simplified control panel 300 of platform 50. Joysticks 302 and 304 are shown on control panel 300 for implementing Cartesian movement of the operator platform 50. Those of ordinary skill in the art will recognize that numerous other control features besides the illustrated joysticks 302, 304 may be incorporated into control panel 300.

Joystick 304, shown on the left side of control panel 300, operates to move operator platform 50 in the "z" plane of Cartesian movement. In other words, as indicated by arrows 314, 316, joystick 304 implements vertical movement (up and down) of operator platform 50. With respect to joystick 302, movement can be implemented in the "x-y" plane of Cartesian movement. In other words, as indicated by arrows 306, 308, joystick 302 can implement movement of operator platform 50 in a forward and reverse direction, respectively. Furthermore, if joystick 302 is moved in accordance with arrows 310, 312, operator platform may be moved in a lateral or a left or right direction. Although not shown in FIG. 3, alternate embodiments may also include a "twist" function of one or the other of joysticks 302, 304. Such twisting function would provide an operator the capability of turning operator platform 50 in a rotational manner. As is typical and would be understood by those of ordinary skill in the art, movement of joysticks 302 and 304 provide proportional outputs.

Although FIG. 3 illustrates two joysticks for implementing Cartesian movement of operator platform 50, alternate embodiments may eliminate joystick 304. In its place, joystick 302 could have a toggle control 303 (shown in dashed-line black box form in FIG. 3) mounted on its top surface for raising and lowering operator platform 50.

The system and methods of the present invention therefore provide a control mechanism whereby the operator is able to operate the operator platform 50 in Cartesian space, requiring only the indication of which direction the operator desires the operator platform 50 to travel in. Although the present invention has been described in conjunction with particular preferred structures, and in conjunction with generalized, preferred methods of operation for these structures, those skilled in the art will recognize many other modifications to the structures and methodology that still fall within the scope of the invention. The specific electrical and electronic functionality associated with components like the electronic controller 80, the gyroscopic sensor 51, and the accelerometer 52 may, for example, be implemented in any of a number of different ways using a variety of different electronic and/or mechanical components. As long as the electronic controller 80 is appropriately programmed or electronically structured to receive the signals or electrical characteristics from these electronic devices and sensors, then any of a number of different electrical components may be used for these two inventive elements. In some cases, electrical or electronic devices may be used in place of the mechanical linkages described herein. Hard wired connections can also be replaced with wireless connections to the extent not clearly forbidden by the properly construed claims. Certainly, modifications as to geometry, shape, and size could and likely would vary according to the size and placement of the existing control systems associated with a particular device.

In all respects, it should also be understood that the drawings and detailed description herein are to be regarded in an illustrative rather than a restrictive manner, and are not intended to limit the invention to the particular forms and examples disclosed. Rather, the invention includes all embodiments and methods within the scope and spirit of the invention as claimed, as the claims may be amended, replaced or otherwise modified during the course of related prosecution. Any current, amended, or added claims should be interpreted to embrace all further modifications, changes, rearrangements, substitutions, alternatives, design choices, and embodiments that may be evident to those of skill in the art, whether now known or later discovered. In any case, all substantially equivalent systems, articles, and methods should be considered within the scope of the invention and absent express indication otherwise, all structural or functional equivalents are anticipated to remain within the spirit and scope of the present inventive system and method.

The invention claimed is:

1. A system for controlling a boom lift, said system comprising:

a) an operator platform including a gyroscopic sensor, an accelerometer, and an electronic controller;

b) an upper telescoping assembly attached to said operator platform;

c) a lower telescoping assembly attached to said upper telescoping assembly;

d) two or more rotary joints positioned on the boom lift, wherein each of said two or more rotary joints serves as an assembly controller configured for adjusting a position of the boom lift;

e) a first joystick and a second joystick, said first joystick being configured for implementing movement of said operator platform in an X-Y plane, and said second joystick being configured for implementing movement of said operator platform in a Z plane;

f) said electronic controller comprising a processor and a memory unit;

g) said electronic controller being adapted to:

1) receive input signals from said gyroscopic sensor and said accelerometer, said input signals from said gyroscopic sensor and said accelerometer being indicative of a current position of said operator platform;

2) receive input signals from at least one of said first joystick or said second joystick, said input signals from at least one of said first joystick or said second joystick including a desired angle and/or length of at least one of said upper and lower telescoping assemblies;

3) calculate the desired angle and/or length of at least one of said upper and lower telescoping assemblies based on said input signals from said at least one of said first joystick or said second joystick;

4) calculate current angles and/or lengths of said upper and lower telescoping assemblies based on said input signals from said gyroscopic sensor and said accelerometer;

5) compare the desired angle and/or length of at least one of said upper and lower telescoping assemblies to the current angles and/or lengths of said upper and lower telescoping assemblies; and 6) communicate a control signal to at least one of said two or more rotary joints to achieve the desired angle and/or length of at least one of said upper and lower telescoping assemblies.

2. The system of claim 1, wherein said gyroscopic sensor and said accelerometer are solid state sensors.

3. The system of claim 1, wherein said system is implemented in a lift vehicle.

4. The system of claim 1, wherein said two or more rotary joints include:

a) an uppermost rotary joint that is movable in one axis of rotation; and b) a lowermost rotary joint that is movable in two axes of rotation.

5. The system of claim 1, wherein said electronic controller is further configured to:

a) monitor for failure of said gyroscopic sensor and said accelerometer; and b) communicate a safety control signal to said two or more rotary joints.

6. A system for controlling a boom lift, said system comprising:

a) an operator platform having a gyroscopic sensor, an accelerometer, and an electronic controller;

b) an upper telescoping assembly attached to said operator platform;

c) a lower telescoping assembly attached to said upper telescoping assembly;

d) two or more rotary joints positioned on the boom lift, wherein each of said two or more rotary joints serves as an assembly controller configured for adjusting a position of the boom lift;

e) a joystick being configured for implementing movement of said operator platform in an X-Y plane;

f) said electronic controller comprising a processor and a memory unit;

g) said electronic controller being configured to store a platform location algorithm and a platform control algorithm; and h) said electronic controller being further configured to:

1) monitor said joystick for an operator desired action, wherein the operator desired action includes desired angles and/or lengths of said upper and lower telescoping assemblies;

2) receive signals from said gyroscopic sensor and said accelerometer;

3) use the platform location algorithm and said signals from said gyroscopic sensor and said accelerometer to compute current angles and/or lengths of said upper and lower telescoping assemblies;

4) compare the desired angles and/or lengths of said upper and lower telescoping assemblies to the current angles and/or lengths of said upper and lower telescoping assemblies;

5) use the platform control algorithm to calculate a control signal to achieve the desired angles and/or lengths of said upper and lower telescoping assemblies; and 6) communicate the control signal to at least one of said two or more rotary joints, wherein said at least one of said two or more rotary joints implements movement of said upper and/or lower telescoping assemblies to achieve the desired angles and/or lengths of said upper and lower telescoping assemblies.

7. The system of claim 6, wherein said gyroscopic sensor and said accelerometer are solid state sensors.

8. The system of claim 6, wherein said joystick includes a toggle control, said toggle control being operable to implement movement of said operator platform in a Z plane.

9. The system of claim 6, wherein said system is implemented in a lift vehicle.

10. The system of claim 6, wherein said two or more rotary joints include:

a) an uppermost rotary joint that is movable in one axis of rotation; and b) a lowermost rotary joint that is movable in two axes of rotation.

11. The system of claim 6, wherein said electronic controller is further configured to:

a) monitor for failure of said gyroscopic sensor and said accelerometer; and b) communicate a safety control signal to said two or more rotary joints.

12. A system for controlling a boom lift, said system comprising:

a) an operator platform including a gyroscopic sensor, an accelerometer, and an electronic controller, wherein said gyroscopic sensor and said accelerometer are solid state sensors;

b) an upper telescoping assembly attached to said operator platform;

c) a lower telescoping assembly attached to said upper telescoping assembly;

d) two or more rotary joints positioned on the boom lift, wherein each of said two or more rotary joints serve as an assembly controller configured for adjusting a position of the boom lift, and wherein said two or more rotary joints include:

1) an uppermost rotary joint that is movable in one axis of rotation; and 2) a lowermost rotary joint that is movable in two axes of rotation;

e) a first joystick being configured for implementing movement of said operator platform in an X-Y plane;

f) a second joystick being configured for implementing movement of said operator platform in a Z plane;

g) said electronic controller comprising a processor and a memory unit; and h) said electronic controller being adapted to:

1) receive input signals from said gyroscopic sensor and said accelerometer, said input signals being indicative of a current position of said operator platform;

2) receive input signals from at least one of said first joystick and said second joystick, said input signals from at least one of said first joystick and said second joystick including a desired angle and/or length of at least one of said upper and lower telescoping assemblies;

3) calculate the desired angle and/or length of at least one of said upper and lower telescoping assemblies based on said input signals from said at least one of said first joystick or said second joystick;

4) calculate current angles and/or lengths of said upper and lower telescoping assemblies based on said input signals from said gyroscopic sensor and said accelerometer;

5) compare the lengths desired angle and/or length of at least one of said upper and lower telescoping assemblies to the current angles and/or lengths of said upper and lower telescoping assemblies; and 6) communicate a control signal to at least one of said two or more rotary joints to implement movement of the boom lift to achieve said desired angles and/or lengths of said upper and lower telescoping assemblies.

* * * * *